US007073887B2

(12) United States Patent
Yoshida

(10) Patent No.: US 7,073,887 B2
(45) Date of Patent: Jul. 11, 2006

(54) INK-JET PRINTING APPARATUS

(75) Inventor: Masahito Yoshida, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 273 days.

(21) Appl. No.: 10/766,818

(22) Filed: Jan. 30, 2004

(65) Prior Publication Data

US 2004/0183854 A1 Sep. 23, 2004

(30) Foreign Application Priority Data

Jan. 31, 2003 (JP) ..... 2003-024919

(51) Int. Cl.
*B41J 2/165* (2006.01)

(52) U.S. Cl. ..... 347/36; 347/30

(58) Field of Classification Search ..... 347/22, 347/29, 33, 32, 35, 36, 31, 30
See application file for complete search history.

(56) References Cited

U.S. PATENT DOCUMENTS 5,717,444 A * 2/1998 Sugimoto et al. ..... 347/29

6,019,452 A * 2/2000 Hirano et al. ..... 347/30

* cited by examiner

*Primary Examiner*—Shih-Wen Hsieh
(74) *Attorney, Agent, or Firm*—Fitzpatrick, Cella, Harper & Scinto

(57) ABSTRACT

An ink-jet printing apparatus includes a recovery section having a pump for discharging ink from an ink-ejection portion of a printing head by the application of a suction force thereto. In the recovery section, the pump and the waste ink absorber for retaining the waste ink are disposed approximately at the same height so that the printing apparatus becomes thinner and is improved in portability. An interior space having a sealed waste ink flow passage for connecting the recovery section to the waste ink absorber is provided, in which a flow passage absorber is accommodated so that a gap is formed from a connection with the discharging port of the pump to a connection with the waste ink absorber and is further connected to the waste ink absorber. Thereby, the waste ink is effectively and securely guided to the waste ink absorber and securely retained there, without leakage.

8 Claims, 8 Drawing Sheets

INK-JET PRINTING APPARATUS

This application claims priority from Japanese Patent Application No. 2003-024919 filed Jan. 31, 2003, which is incorporated hereinto by reference.

BACKGROUND OF THE INVENTION

1. Field of the Invention

The present relates to an ink-jet printing apparatus for carrying out the printing operation by ejecting ink from printing means onto a printing medium.

2. Description of the Related Art

Recording apparatuses having functions of a printer, a copying machine, a facsimile recorder or others or those used as an outputting device for a composite type electronic equipment or a work station such as a computer or a word processor are adapted to print images on a printing medium such as paper, cloth or plastic sheet. The printing apparatuses may be classified into an ink-jet type, a wire dot type, a thermal type, a laser beam type or others in accordance with the printing methods.

According to a serial type printing apparatus wherein a serial scanning system is adopted, after the printing medium has been set at a predetermined printing position, an image is scanned along the printing medium by a printing means carried on a carriage (a main scanning), and after the printing of one line has finished, a predetermined amount of the printing medium is conveyed (a sub-scanning) and stopped. Then, an adjacent image is scanned and printed again on the stopped printing medium. By repeating these motions, printing on the entire printing medium is carried out. On the other hand, there is a printing apparatus of a line type using printing means having printing elements arranged in a range corresponding to a width of a printing medium, capable of carrying out the printing operation solely by the sub-scanning in the conveying direction. In this apparatus, the printing medium is first set at the predetermined printing position, and after the printing of one line has been at once completed, the predetermined amount of the printing medium is fed (the pitch feed). Then, the printing of the next one line is carried out at once. According to the repetition of such operations, printing all over the printing medium is completed.

Of the above-mentioned printing systems, a printing apparatus employing the ink-jet system (the ink-jet printing apparatus) carries out the printing operation while ejecting ink from printing means (a printing head) onto a printing medium, and has advantages in that the printing means is capable of being easily small-sized; a high-precision image is printed at a high speed; the printing is carried out on a so-called normal paper which has not been subjected to a special treatment whereby a running cost is reduced; the noise generation is less because of a non-impact system; and it is easily adaptable to the printing of color images using multi-color inks.

There are a serial type and a line type in the above ink-jet printing apparatus. In the former type, an image is formed by alternately repeating the main printing scan in which the printing operation is carried out while subjecting printing means (a printing head) including a plurality of printing elements (ejection orifices) to the scanning motion relative to a printing medium with the sub-scan in which the printing medium is conveyed in the direction vertical to that of the main printing scan. This type is suitable for a personal use and has been widely marketed because it is inexpensive in production cost and small in size. On the other hand, in the latter type, a so-called full multiple type printing head is used, in which a number of ejection orifices are arranged in the widthwise direction of the printing medium, and an image is completed by moving the printing medium in the direction different from the arrangement of the ejection orifices. Although the printing apparatus is large in size and relatively expensive since the printing head becomes longer, this type is superior to the serial type in the printing speed.

In this regard, there are various ejection systems in the printing head employing the ink-jet system. Particularly, the printing head of the ink-jet system for ejecting ink by utilizing thermal energy is capable of realizing the high precision and high speed of the printing as well as further compacting the printing apparatus used therefor, because a number of liquid passages or ejection orifices is easily and precisely manufactured on a substrate through processes similar to those for producing a semiconductor device, such as etching, depositing or sputtering to form electro-thermal transducers, electrodes, liquid passage walls or top plates.

Generally speaking, according to such an ink-jet printing apparatus, a device is often added for carrying out the recovery action (recovery operation) for maintaining or recovering the stable ink ejection performance. The recovery action includes a wiping for removing viscous ink or paper powder adhered to an area in the vicinity of the ejection orifice by wiping the ejection orifice-forming surface of the printing head with a wiping member, a suction recovery for forcibly sucking viscous ink or air bubble from the interior of the printing head by applying a suction force to the printing head, and a preliminary ejection for ejecting viscous ink from the liquid passages not used during the printing operation to replace it with fresh ink.

In this regard, the suction recovery is carried out by capping the ejection orifice-forming surface and applying a negative pressure thereto to forcibly suck the ink from the ejection orifices. As means for carrying out such a recovery operation, the printing apparatus is generally provided with a pump. The pump may be a so-called tube pump using a roll moving while collapsing a flexible tube or a piston pump having a piston moving in a cylinder, and a relatively large amount of waste ink is generated in the recovery operation.

The waste ink generated by the recovery operation is introduced from the recovery device to a waste ink absorber provided within a main body of the printing apparatus and is retained there while taking care not to leak outside. The waste ink absorber is often a sheet member of fibers excellent in ink absorbency and diffusivity due to the capillary action.

FIG. 1 is a perspective view illustrating the conventional ink-jet printing apparatus.

The illustrated ink-jet printing apparatus includes a paper-feed section 10 for feeding a printing medium one by one to a conveying section 20 within a main body of the printing apparatus, the conveying section 20 for guiding the printing medium to a predetermined printing position and then discharging the same therefrom, a discharging section 30 located downstream from the conveying section 20, a printing section 40 for carrying out the printing operation in accordance with image data on the printing medium conveyed by the conveying section 20, a recovery section 60 for carrying out the recovery treatment for the printing section 40 or others, and a chassis 71 for supporting these sections to construct the integral printing apparatus.

FIG. 2 is a perspective view for illustrating the arrangement of the recovery section 60 of the ink-jet printing apparatus 60 and the waste ink absorber. In the conventional ink-jet printing apparatus, the waste ink absorber 64 is disposed on a lower case 4 beneath the recovery section 60 as a layout within the apparatus, for receiving the waste ink generated while being accompanied with the recovery operation, diffusing the same into the absorber 64 due to the capillary action of the absorber-forming material, and retaining the ink while evaporating solvent.

It has recently been desired that the ink-jet printing apparatus is further small-sized to have a high-portability. To satisfy such a requirement, a height (a thickness) of the apparatus body is preferably as small as possible. However, the conventional structure in which the waste ink absorber is disposed beneath the recovery device has been a bottleneck for designing such a thin type printing apparatus. Also, the inconvenience in that the waste ink is leaked out from the apparatus should be avoided for the purpose of improving the portability, even if the apparatus is transported or conveyed in any orientations.

SUMMARY OF THE INVENTION

An object of the present invention is to realize a printing apparatus of an ink-jet type small in size and high in portability as well as capable of effectively and securely guiding waste ink generated during the recovery operation to the whole of a waste ink absorber and retaining the same without the leakage even if the apparatus is disposed in any posture.

According to the present invention, an ink-jet printing apparatus is provided, for carrying out the printing operation by using printing means for ejecting ink, comprising recovery means for recovering the ink ejection of the printing means in a favorable state by receiving ink from the printing means, and ink-retaining means for absorbing and retaining the ink received in the recovery means and discharged from a discharging section thereof through a flow passage, wherein the recovery means and the ink-retaining means are disposed approximately at the same height when the ink-jet printing apparatus is in the posture to be used, and the flow passage is formed as a sealed space except for portions connected to the discharging portion of the recovery means and to the ink-retaining means; the flow passage being provided with an absorber while remaining a gap from the discharging portion to the ink-retaining means.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

The present invention will be described in more detail below with reference to the attached drawings.

Figure 3:
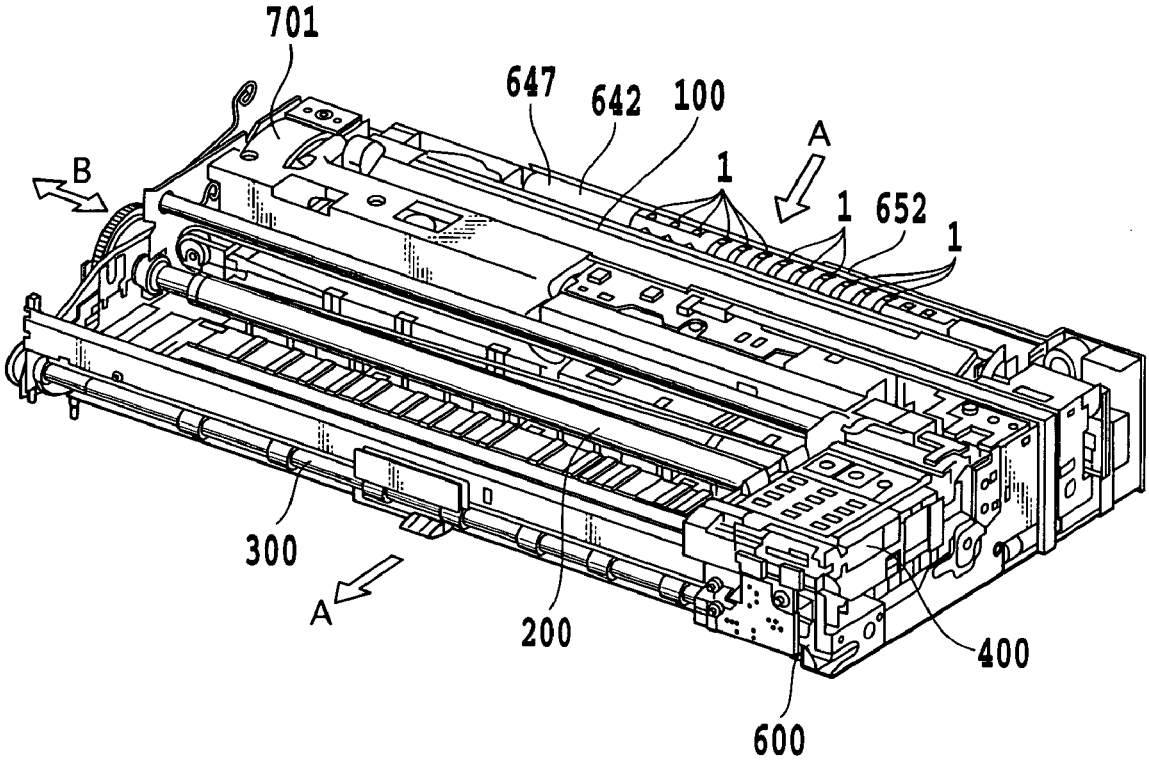
FIG. 3 is a perspective view of an ink-jet printing apparatus according to one embodiment of the present invention while removing an outer case thereof so that a printing mechanism thereof is exposed as a whole.

FIG. 3 is a perspective view of an ink-jet printing apparatus according to one embodiment of the present invention while removing an outer case thereof so that a printing mechanism thereof is exposed as a whole.

Figure 1:
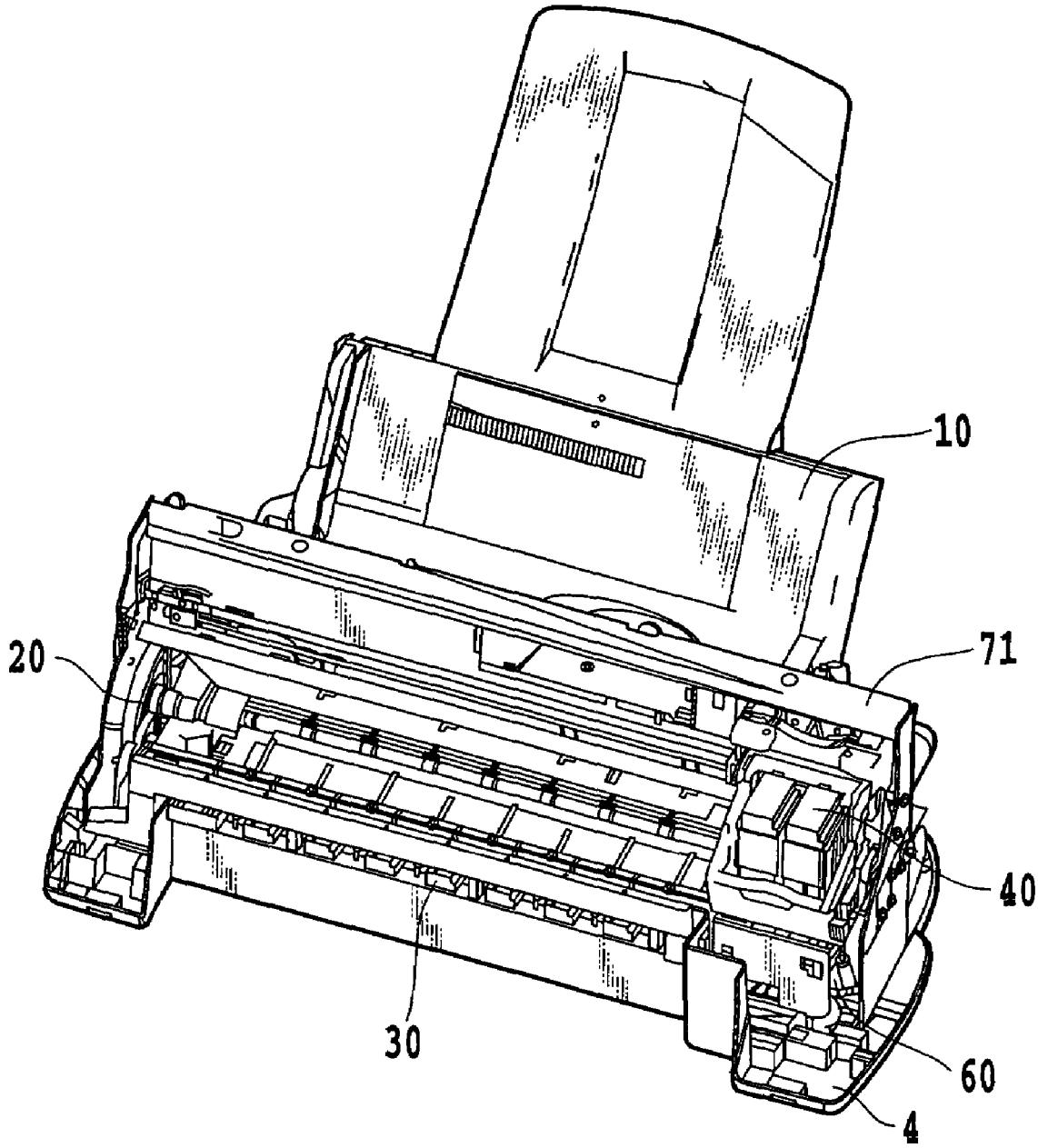
FIG. 1 is a perspective view of the conventional ink-jet printing apparatus illustrating the structure thereof.

The printing mechanism according to this embodiment includes, similar to the conventional apparatus shown in FIG. 1, a paper-feed section 100 for feeding a printing medium one by one to a conveying section 200 within a main body of the printing apparatus, the conveying section 200 for guiding the printing medium to a predetermined printing position and then discharging the same therefrom, a discharging section 300 located downstream from the conveying section 200, a printing section 400 for carrying out the printing operation in accordance with image data on the printing medium conveyed by the conveying section 200, a recovery section 600 for carrying out the recovery treatment for the printing section 400 or others, and a chassis 701 for supporting these sections to construct the integral printing apparatus. The conveying direction of the printing medium (the sub-scanning direction) is indicated by an arrow A and the reciprocation direction of the printing section 400 (the main scanning direction) is indicated by an arrow B.

Figure 2:
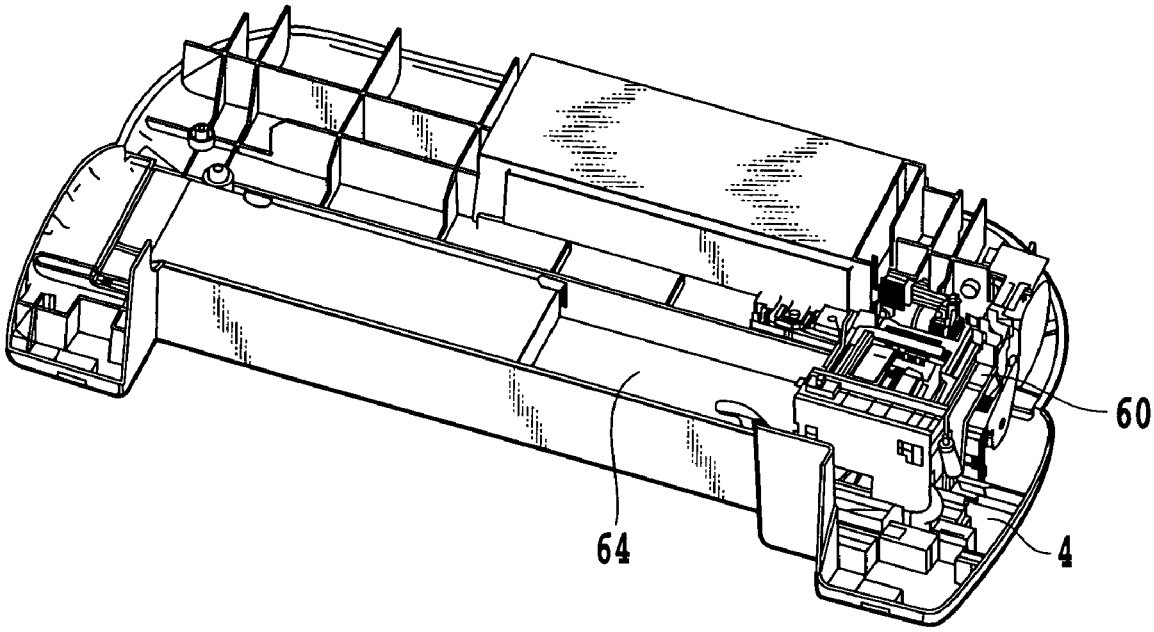
FIG. 2 is a perspective view illustrating the arrangement of the recovery section of the ink-jet printing apparatus shown in FIG. 1 and an absorber for retaining waste ink generated during the recovery operation.

This embodiment is largely different from the conventional one in that while the waste ink absorber 64 is disposed on the lower case 4 beneath the recovery section 60 in the conventional apparatus as shown in FIG. 2, a drain pack 642 which operates as a waste ink absorbing section in the illustrated posture during the ordinary use is disposed rearward from the paper-feed section 100 in this embodiment. Thereby, a thickness (a height) of the ink-jet printing apparatus is reduced so that the ink-jet printing apparatus smaller in size and more excellent in portability performance is realized. The construction therefor and that capable of effectively and securely guiding the waste ink generated by the recovery operation throughout the waste ink absorber without any leakage irrespective of the posture thereof will be described below in more detail.

Figure 4:
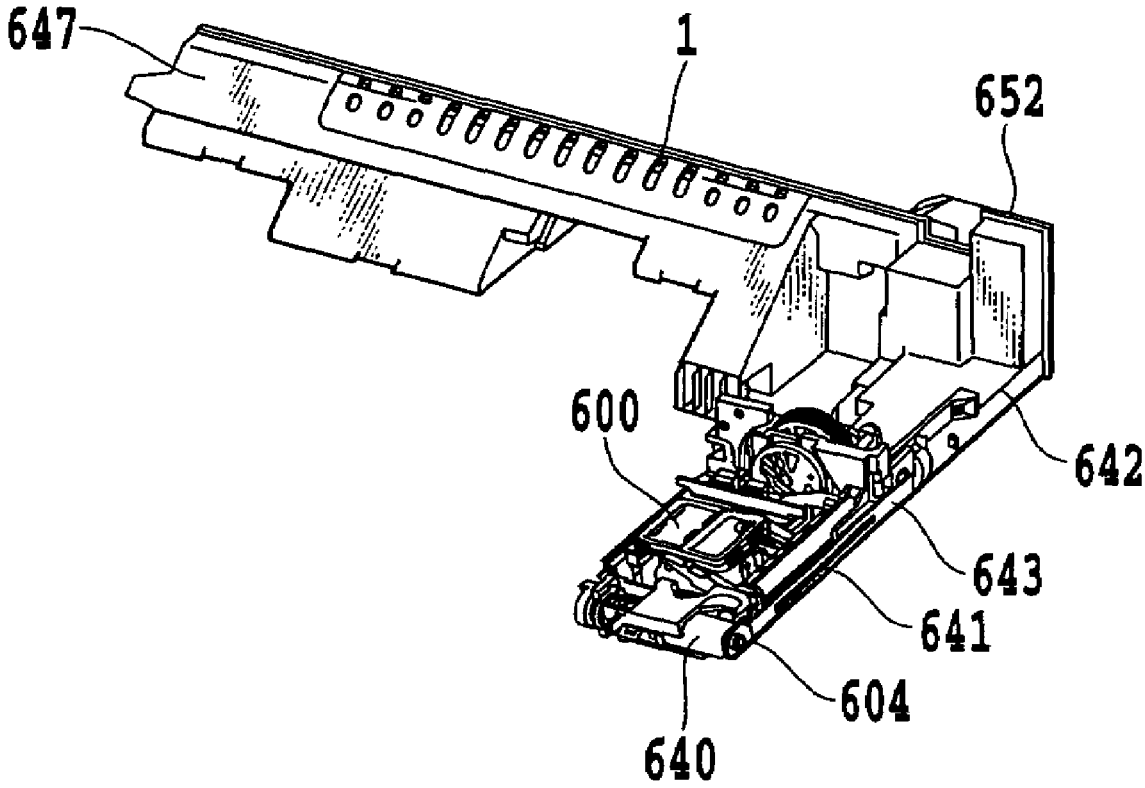
FIG. 4 is a perspective view illustrating the arrangement of the recovery section of the ink-jet printing apparatus shown in FIG. 3 and a drain pack as a member for retaining waste ink generated during the recovery operation.

FIG. 4 is a perspective view illustrating the arrangement of the recovery section 600 of the ink-jet printing apparatus shown in FIG. 3 and a drain pack 642.

Reference numeral 640 denotes a pump which is a piston pump type in this embodiment for forcibly sucking ink from ejection orifices by the application of a negative pressure to an ejection orifice-forming surface during the suction recovery operation. The waste ink discharged from a discharging port of the pump 640 passes a waste ink flow passage 641 formed by welding a cover member 643 to a base 604 supporting the pump and other mechanisms and is transferred and absorbed into a waste ink absorber 645 within the drain pack. 642 disposed rearward from the paper-feed section 100, that is, on a back side of the main body mechanism due to the capillary phenomenon. The drain pack 642 is prepared by accommodating the waste ink absorber 645 excellent in ink-absorbability and diffusivity in a drain pack case member 647 and welding a drain pack cover member 652 thereto to seal the waste ink.

Figure 5:
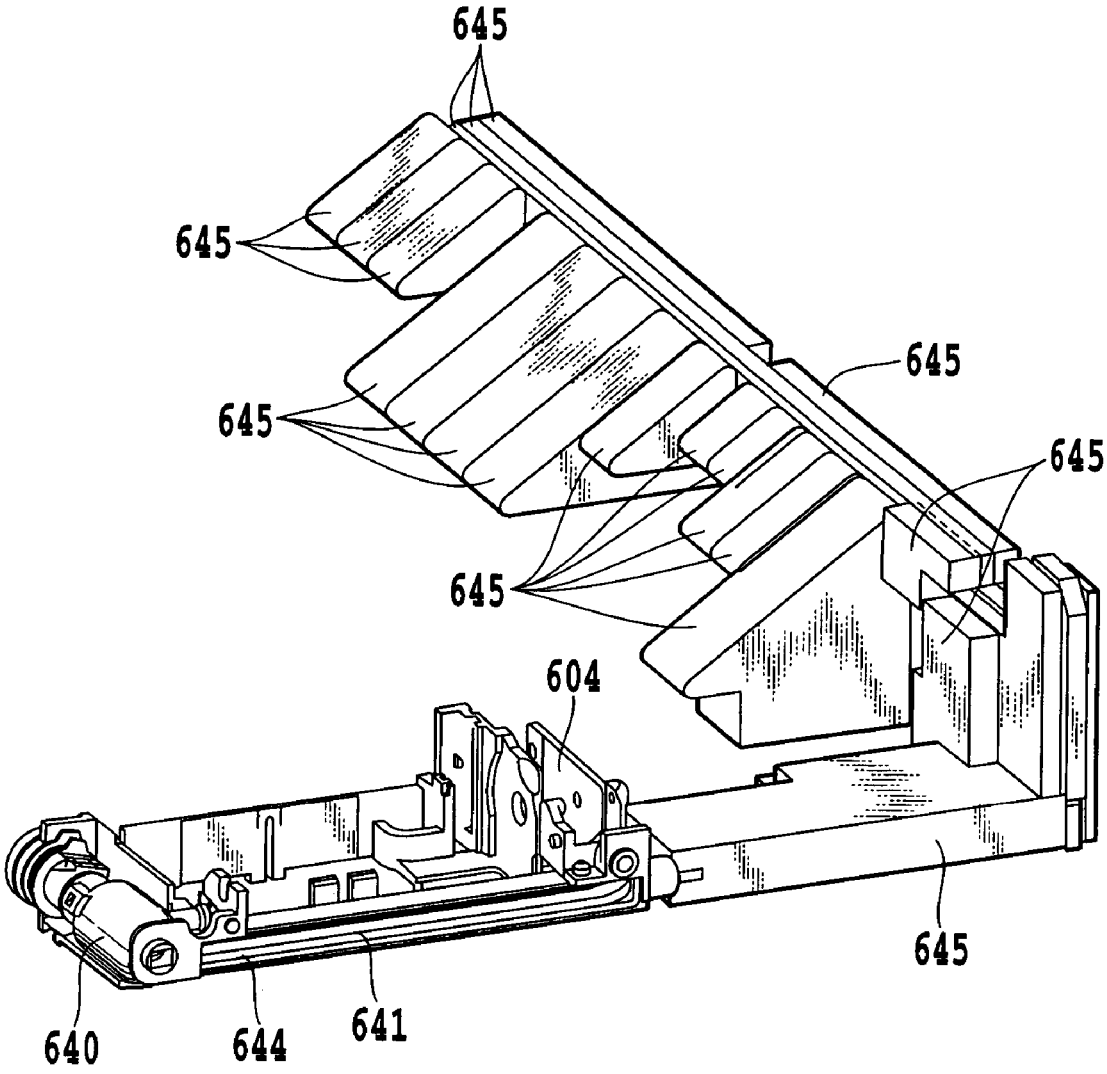
FIG. 5 is a perspective view illustrating a portion in FIG. 4 relating to the transfer and absorption of waste ink for explaining the structure of a waste ink system from a pump to a waste ink absorber forming the recovery section according to this embodiment.
Figure 6:
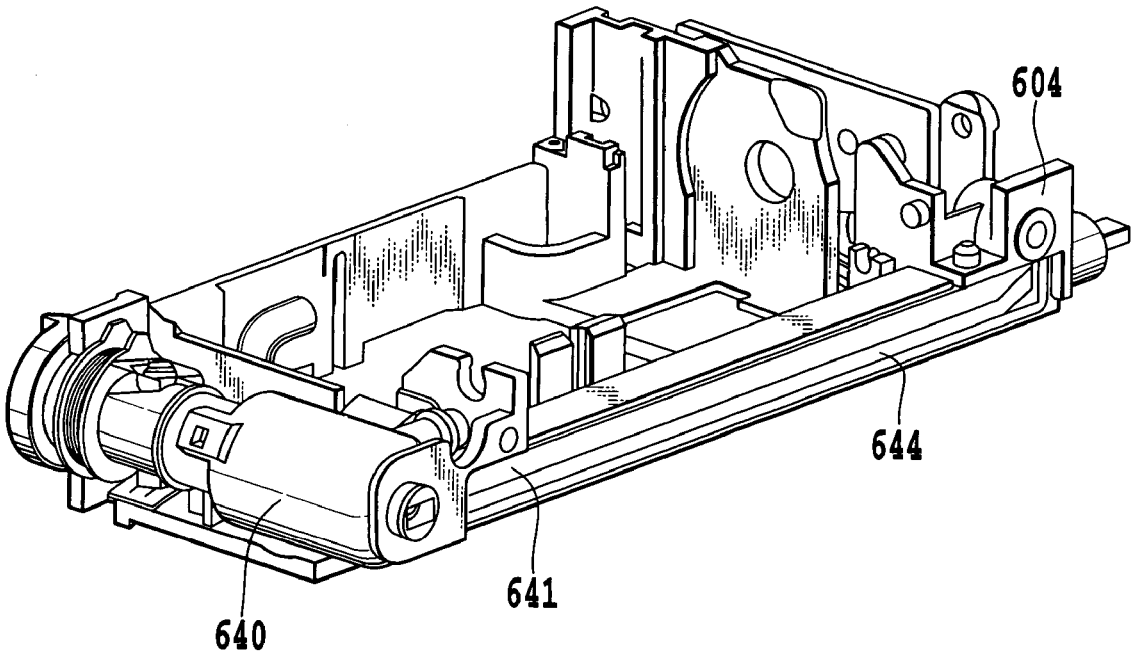
FIG. 6 is a perspective view illustrating a portion in FIG. 4 relating to the transfer and absorption of waste ink for explaining the structure of a waste ink system from a pump to a waste ink absorber forming the recovery section according to this embodiment.

FIGS. 5 and 6 are perspective views illustrating a portion relating to the transfer and absorption of the waste ink for the purpose of explaining the structure of the waste ink system extending from the pump 640 to the waste ink absorber 645.

First, the waste ink flow passage 641 provided on a base 604 is formed by welding a base cover member 643 illustrated in FIG. 4 to the base 604 to be a space, for example, of a rectangular cross-section having a height of approximately 4 mm and a width of 4 mm, horizontally extending from a discharging port of the piston pump 640 to the drain pack 642 by a length of approximately 80 mm to be closely sealed except for one end connected to the discharging port of the piston pump 640 and the other end coupled to the waste ink absorber 645 within the interior of the drain pack 642. In the interior of the waste ink flow passage 641, a flow passage absorber 644 of 2 mm thick made of the same or equivalent material as the waste ink absorber 645 in the drain pack 642 is disposed, one end of which is brought into contact with the waste ink absorber 645.

That is, according to this embodiment, the recovery section 600 including the pump 640 and the waste ink absorber 645 in the drain pack 642 for retaining waste ink discharged from the recovery section 600 are disposed approximately at the same height when the printing apparatus occupies a position at which it is used, and the waste ink flow passage 641 for connecting both to each other has the interior space sealed from outside, in which the flow passage absorber 644 is disposed so that a gap extends from a portion connected to the discharging port of the pump 640 to a portion connected to the drain pack 642. The flow passage absorber 644 is disposed while being connected to the waste ink absorber 645. Further, the waste ink flow passage 641 is provided integrally with the base 605 of the recovery section 600 to connect the ink discharging port of the pump 640 disposed within the recovery section 600 with the waste ink absorber accommodated in the drain pack 642.

The ink discharged from the pump 640 in accordance with the recovery operation is absorbed in the flow passage absorber 644 and then absorbed and diffused in the waste ink absorber 645 due to the capillary phenomenon. While the absorption/diffusion speed may be different in accordance with the difference in posture of the product, the waste ink is absorbed and diffused from the recovery section to the drain pack.

When the ink is sequentially discharged, for example, for the purpose of eliminating the clogged nozzles of the printing head whereby the discharging rate exceeds the absorption speed of the flow passage absorber 644, the overflowing ink is once retained in the sealed space which is the gap between the inner walls of the waste ink flow passage 641 and the flow passage absorber 644, and then gradually absorbed in the flow passage absorber 644 and further in the waste ink absorber 645 as the time has lapsed.

In this regard, the waste ink flow passage 641 is formed by attaching a flat plate-like cover member to a groove prepared in advance on the base 604. Or it may be formed by attaching a channel-like cover member to the base surface, or it may be formed by attaching a channel-like cover member to a groove formed on the base 604.

Also, the base 604 may be utilized as a base for mounting the pump 640 which is a constituent element of the recovery section 600 and a motor or the like used for a drive source for carrying out the recovery operation including a driving of the pump 640 and for carrying out the feeding operation of the printing medium.

Further, the pump 640 may be not only the above-mentioned piston pump but also a tube pump.

Next, according to this embodiment, the drain pack case member 647 extends in the main scanning direction from a portion disposed rearward of the recovery section 600 and connected with the waste ink flow passage 641 along a rear side of the printing apparatus. This member is suitably modified not to interfere with other constituent members of the printing apparatus and has a tapered surface for guiding the inserted printing medium into the interior of the apparatus. Also, the waste ink absorber 645 is filled in almost all of the interior space of the drain pack case member 647 in conformity with the interior space as shown in FIG. 5.

The structure of the drain pack case member 647 will be described below in more detail.

Figure 7:
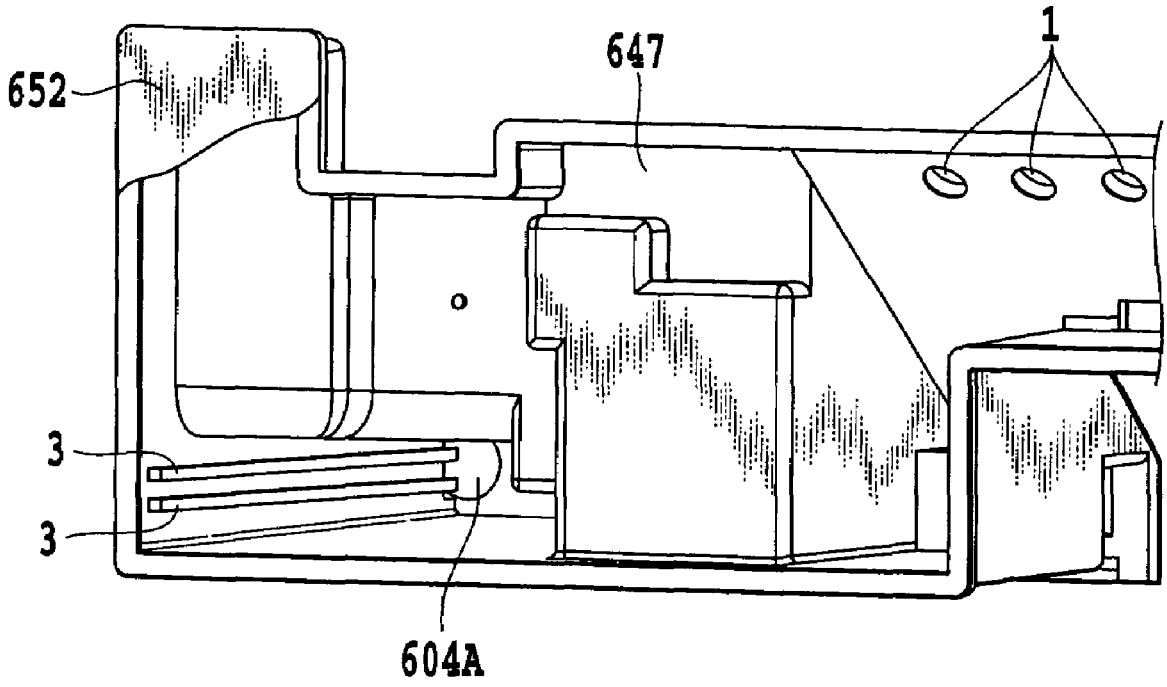
FIG. 7 is a perspective view illustrating the internal structure of a drain pack case member forming a drain pack.
Figure 8:
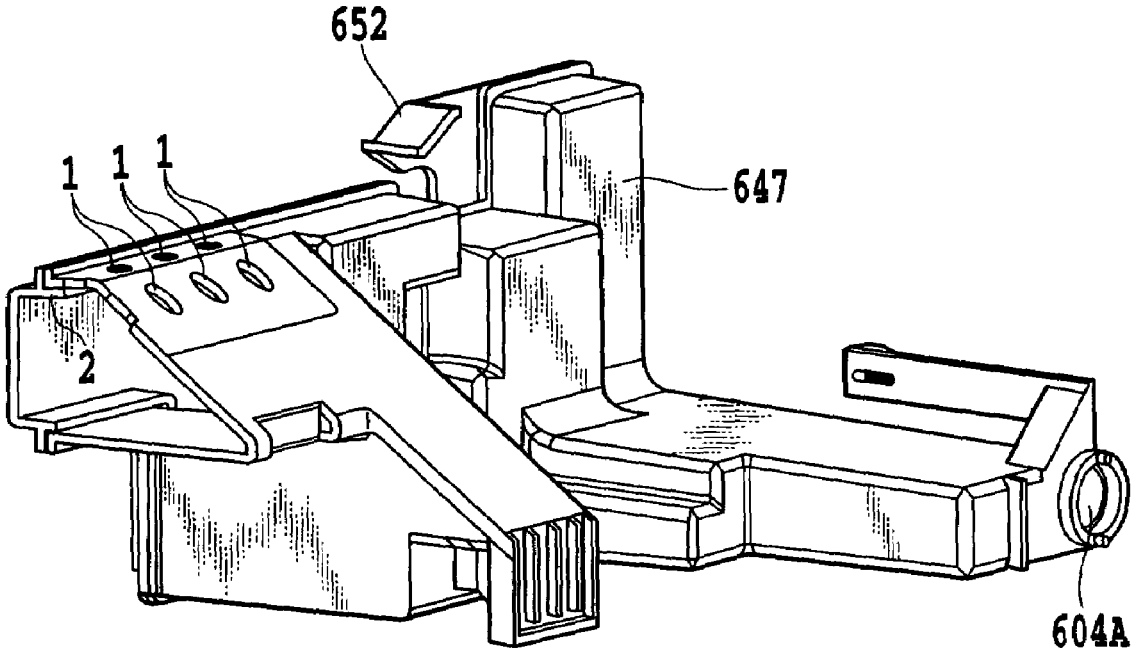
FIG. 8 is a partially broken perspective view of the assembled drain pack in which a drain pack cover member is attached to the drain pack case member.

FIG. 7 is a perspective view for illustrating the interior structure of the drain pack case member 647. FIG. 8 is a partially broken perspective view for illustrating the drain pack 642 assembled by attaching the drain pack cover member 652 to the drain pack case member 647.

In the drain pack case member 647 of this embodiment, two ribs 3 extend in parallel to each other from one end 604A of the base 604 coupled to the waste ink flow passage 641 in the base 604 to a welded portion of the drain pack cover member 652. Thereby, when the drain pack 642 is assembled, an extremely thin space is defined at roots of the ribs 3 between the absorber 645 and the inner wall of the drain pack case member 647.

By extending the ribs 3 in a suitable manner, the space defined at the roots thereof is further connected to a rib 2 for positioning the drain pack cover member 652 when welded, so that a gap formed [at a root of] by the rib 2 is communicated with outer air through holes 1 provided in the upper part of the drain pack case member 647. The extending portion of the ribs 3 may be formed on the drain pack case member 647 or the drain pack cover member 652. Thereby, the interior space of the waste ink flow passage 641 provided in the base 604 is communicated with outer air through a gap defined by the ribs 2 and 3 between the inner wall of the drain pack 642 and the absorber 545.

That is, in this embodiment, the waste ink absorber 645 is sealed in the drain pack 642 except for the portion 604A connected to the waste ink flow passage 641 and the holes 1 communicated with outer air, and a continuous space is formed between the portion connected to the waste ink flow passage 641 and the holes 1 through the gap between the outer surface of the waste ink absorber 645 and the inner wall of the drain pack. This continuous space within the interior of the drain pack 642 is connected to the space in waste ink flow passage 641 and contiguous thereto.

As a result, since the discharging port of the piston pump 640 is communicated from the space in the waste ink flow passage 641 to outer air through the gap in the drain pack 642, the flow passage resistance on the ink-discharging side of the piston pump 640 is suppressed to a lower level. Also since the waste ink is completely absorbed into the waste ink absorber 645 while passing through the gap, it is prevented from leaking outside until the waste ink absorber 645 has been saturated.

In this regard, the continuous space within the interior of the drain pack 642 may be formed to be narrower as approaching the holes 1 for the communication with outer air so that the resistance against the waste ink flowing toward the holes 1 becomes larger to facilitate the absorption thereof into the waste ink absorber 645 and furthermore prevent the leakage of the waste ink.

As described hereinabove, according to the present invention, it is possible to realize an ink-jet printing apparatus small in size and high in portability, capable of effectively and securely guiding the waste ink generated by the recovery operation throughout the waste ink absorber and retaining the same without leakage even if the apparatus is disposed in any posture.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing apparatus for carrying out a printing operation by using printing means for ejecting ink, comprising:

recovery means for recovering the an ink ejection state of the printing means by receiving ink from the printing means; and ink-retaining means for absorbing and retaining the ink received in said recovery means and discharged from a discharging portion thereof through a flow passage, wherein said recovery means and said ink-retaining means are disposed approximately at the same height when said ink-jet printing apparatus is in a use orientation, and the flow passage is formed as a sealed space except for portions connected to the discharging portion of said recovery means and to said ink-retaining means, the flow passage being provided with an absorber while maintaining a gap between walls of the flow passage and the absorber and extending from the discharging portion to said ink-retaining means.

2. An ink-jet printing apparatus as claimed in claim 1, wherein said ink-retaining means comprises a container sealed except for portions connected to the flow passage and communicating with outer air, and a container absorber accommodated in said container.

3. An ink-jet printing apparatus as claimed in claim 2, wherein a continuous space is formed between the portions connected to the flow passage and communicating with outer air, the space extending along an outer surface of the container absorber accommodated in the interior of said container.

4. An ink-jet printing apparatus as claimed in claim 3, wherein the continuous space is connected to and contiguous with the gap of flow passage at the portion connected to the flow passage.

5. An ink-jet printing apparatus as claimed in claim 4, wherein the continuous space is formed to narrow from the portion connected to the flow passage to the portion communicating with outer air.

6. An ink-jet printing apparatus as claimed in claim 2, wherein the absorber disposed in the flow passage is connected to the container absorber accommodated in said container.

7. An ink-jet printing apparatus as claimed in claim 1, wherein the flow passage is integral with said recovery means.

8. An ink-jet printing apparatus as claimed in claim 7, wherein said recovery means comprises a pump for forcibly expelling ink by application of a suction force to an ink-ejection portion of the printing means, and the flow passage is integral with a base for supporting said pump to connect a discharging port of said pump with said ink-retaining means.

* * * * *

UNITED STATES PATENT AND TRADEMARK OFFICE

CERTIFICATE OF CORRECTION

PATENT NO. : 7,073,887 B2
APPLICATION NO. : 10/766818
DATED : July 11, 2006
INVENTOR(S) : Yoshida It is certified that error appears in the above-identified patent and that said Letters Patent is hereby corrected as shown below:

Column 8:

Line 17, "flow" should read --the flow--.

Signed and Sealed this

First Day of May, 2007

JON W. DUDAS
*Director of the United States Patent and Trademark Office*